US009340986B2

(12) United States Patent
Hamilton

(10) Patent No.: US 9,340,986 B2
(45) Date of Patent: May 17, 2016

(54) DECKING GAUGE

(71) Applicant: John Hamilton, Brisbane (AU)

(72) Inventor: John Hamilton, Brisbane (AU)

(73) Assignee: John Hamilton, Brisbane, Queensland (AU)

( * ) Notice: Subject to any disclaimer, the term of this patent is extended or adjusted under 35 U.S.C. 154(b) by 0 days.

(21) Appl. No.: 14/040,762

(22) Filed: Jan. 14, 2014

(65) Prior Publication Data

US 2015/0197945 A1 Jul. 16, 2015

(51) Int. Cl.
*E04F 21/00* (2006.01)
*E04F 21/22* (2006.01)

(52) U.S. Cl.
CPC ..... *E04F 21/0092* (2013.01); *E04F 21/22* (2013.01)

(58) Field of Classification Search
CPC . E04B 1/003; E04B 1/34331; E04B 1/34336; E04B 1/34384; E04B 1/348; E04B 1/3483; E04B 2001/34892; E04B 5/10
USPC ..... 33/526
See application file for complete search history.

(56) References Cited

U.S. PATENT DOCUMENTS

| | | | | |
|---|---|---|---|---|
| 2,466,919 | A * | 4/1949 | Sykes | 33/526 |
| 2,930,135 | A * | 3/1960 | Rodtz, Sr. | 33/518 |
| 3,735,497 | A * | 5/1973 | Boettcher | 33/526 |
| 4,955,142 | A * | 9/1990 | Rieck | 33/526 |
| 5,363,560 | A * | 11/1994 | Makow | 33/527 |
| 7,207,150 | B2 * | 4/2007 | Leek et al. | 52/747.1 |
| 2002/0083610 | A1 * | 7/2002 | Camara et al. | 33/645 |
| 2008/0022629 | A1 * | 1/2008 | Behnecke et al. | 52/750 |
| 2010/0083610 | A1 * | 4/2010 | King | 52/749.1 |

* cited by examiner

*Primary Examiner* — Yaritza Guadalupe-McCall

(57) ABSTRACT

A multi spacing decking tool allows comprising an elongated planar body provided with a plurality of spacers which have V-shaped teeth allows the installer to achieve the even gaps between decking planks and boards by accommodating up to six decking boards at a time, cutting the time it takes to achieve the gaps between boards. The V-shaped teeth enable the gauge to smoothly slot in between each plank or board and will set the same even gap throughout the work surface. The multi spacing decking tool allows the installer to achieve a faster installation of the decking boards.

1 Claim, 3 Drawing Sheets

FRONT VIEW

SIDE VIEW

DECKING GAUGE

BACKGROUND OF THE INVENTION

The present invention relates in general to a tool for use in construction of decks, specifically, a tool for spacing the top surface deck boards. Deck boards are typically spaced apart equidistantly in order to create patterns and allow for drainage. However, spacing the boards equally has proven to be time consuming.

SUMMARY OF THE INVENTION

The present invention provides a multi spacing decking tool comprising a plurality of spacers in the form of V-shaped teeth capable of positioning up to 6 decking boards at a time thus allowing for faster installation with high accuracy spacing.

DETAILED DESCRIPTION OF THE INVENTION

Figure 1:
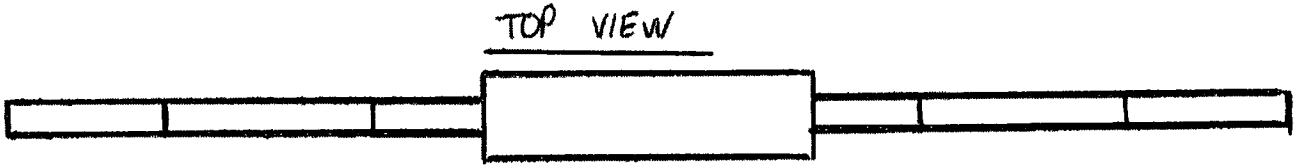
FIG. 1 is the top view of the decking gauge tool, showing the handle and the width of the tool from above.
Figure 2:
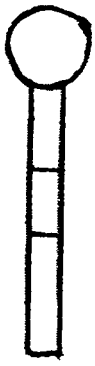
FIG. 2 is the side view of the decking gauge tool, showing the handle of the tool and the width of the decking gauge tool from a side view.
Figure 3:
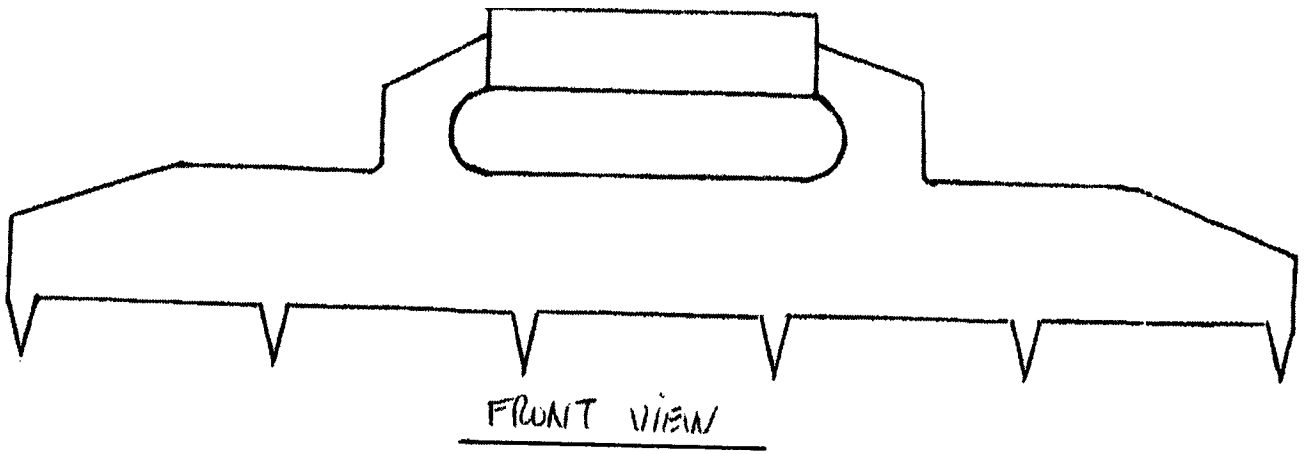
FIG. 3 is the front view of the tool, showing the handle, and the angled teeth on the decking gauge tool and the shape of the decking gauge tool.

The Decking Gauge is a hand held tool which allows the user to position decking boards prior to screwing or nailing. The tool sets out perfect gaps between the decking boards and planks.

Referring to the drawings in details the Decking Gauge comprises an elongated planar body provided with a plurality of spacers which have V-shaped teeth. The V-shaped spacers extend from the lower end of said elongated planar body and their unique shape are designed to give perfect gaps between decking boards. The required gap for any size decking boards is set halfway on each of the teeth directly parallel to each other, thus making the gauges self-setting with perfect gaps achieved between said boards and planks.

The Decking Gauge outlines a round or cylindrical handle extending from the top upper surface of the elongated planar body. The materials used in the manufacture of the Decking Gauge can be steel, aluminum plastics, nylon's or a combination of any of them mentioned materials. The shape of the gauge is designed to accommodate other features.

The invention claimed is:

1. A multi spacing decking tool comprising an elongated planar body provided with a plurality of spacers which have V-shaped teeth, said spacers extending from the lower end of said elongated planar body and capable of positioning up to 6 boards at a time to enable the installer to lay the mutable boards with perfect gaps every time, the configuration of the V-shaped teeth allows the tool to self-set gaps to accommodate timber decking boards that may be of irregular sizes or form, without having to remove a timber board that may be oversized; and a handle extending from the top end of the elongated planar body and having a cylindrical configuration.

* * * * *